US006297779B1

(12) United States Patent
Tsai

(10) Patent No.: US 6,297,779 B1
(45) Date of Patent: Oct. 2, 2001

(54) ANTENNA MODULE FOR PORTABLE COMPUTER

(75) Inventor: Szu-Nan Tsai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/632,369

(22) Filed: Aug. 3, 2000

(30) Foreign Application Priority Data

Apr. 20, 2000 (TW) ..... 089107496

(51) Int. Cl.[7] ..... H01Q 1/24
(52) U.S. Cl. ..... 343/702; 343/793
(58) Field of Search ..... 343/702, 700 MS, 343/793, 795, 803, 820; H01Q 1/24, 9/16

(56) References Cited

U.S. PATENT DOCUMENTS 5,821,903 * 10/1998 Williams ..... 343/702
5,867,131 * 2/1999 Camp, Jr. et al. ..... 343/702
5,966,098 * 10/1999 Qi et al. ..... 343/702

* cited by examiner

*Primary Examiner*—Hoanganh Le
(74) *Attorney, Agent, or Firm*—Wei Te Chung

(57) ABSTRACT

An antenna module 30 of the present invention comprises a wire first dipole antenna arm 32 oriented in a first direction and a wire second dipole antenna arm 34 oriented in a second direction that is perpendicular to the first direction, said two arms being respectively electrically connected to a printed circuit board 36 at two points, and a gap G being formed between the two points. Said two antenna arms are interfaced to the associated transmitting/receiving circuitry by a coaxial cable 38. Values of the length of the two arms, the length of the gap, the diameter of each arm, an impedance of the coaxial cable, and an operating frequency range are chosen to obviate the need for matching circuitry to perform the functions of transfer, balancing and matching between the first and second dipole antenna arms. Therefore, the antenna module is simplified and can be placed compactly at a corner of the portable computer to provide improved performance.

18 Claims, 3 Drawing Sheets

ANTENNA MODULE FOR PORTABLE COMPUTER

BACKGROUND OF THE INVENTION

1. Field of the Invention

The present invention relates to an antenna module and more particularly, to a dipole antenna module operating in a frequency range of 2.40~2.50 GHz for a portable computer.

2. Description of Prior Art

Today, more and more portable computers are being linked with other electrical equipment using wireless telecommunication instead of cabling, defining a WLAN (Wireless Local Area Network) for exchanging data or other signal information. Wireless communication requires that a portable computer be equipped with an antenna module capable of effectively transmitting and receiving electrical signals. A prior art dipole antenna consists of two aligned antenna arms which can only transmits/receives signals in a predetermined direction. This limitation hinders the performance of the portable computer, which is intended for use in a movable application. Furthermore, the performance of the antenna is affected by environment, wherein many sources of reflection may be present. Moreover since the size of the portable computer is of primary concern, the size/volume of the antenna should also be reduced, in particular, when the antenna is located at the corners of the display or body of portable computer. U.S. Pat. No. 5,677,698 discloses an antenna arrangement comprising a slot antenna element. The slot antenna element is located between a dielectric material and a ground plane. When two slot antennas are used to form a diversity configuration, they are connected in such a way that only one antenna which receives a stronger signal will be selected for use while the other is not. The use of two antennas wastes valuable space in the portable computer and is costly.

U.S. Pat. No. 5,966,098 discloses an antenna system comprising a dipole antenna having antenna arms of different lengths, and an impedance matching circuit provided for electrically connecting the antenna arms to the device to increase the antenna gain. Thus, said antenna system not only takes more space, but also has a complicated structure due to an additional impedance matching circuit.

Hence, an antenna module is required to overcome the disadvantages of the prior art and for use with the proliferation of WLANs.

SUMMARY OF THE INVENTION

A first object of the present invention is to provide an antenna module that is compact and simplified and which can be fabricated easily.

A second object of the present invention is to provide an antenna module which can be placed inside the portable computer and has improved performance.

A third object of the present invention is to provide an antenna module that transmits/receives signals from multiple directions and is less sensitive to directional orientation or environment.

An antenna module in accordance with the present invention comprises a wire first dipole antenna arm oriented in a first direction and a wire second dipole antenna arm oriented in a second direction perpendicular to the first direction, said two arms being respectively electrically connected to a printed circuit board at two points, a gap being formed between said two points and no additional matching circuitry. Said two antenna arms are connected to the associated transmitting/receiving circuitry of portable computer by a coaxial cable having an central core electrically engaging with the first dipole antenna arm, and a sheath electrically engaging with the second dipole antenna arm. Therefore, electromagnetic signals can be transmitted at the same frequency from the same electrical circuit but in different directions. The antenna module can be placed at a corner of a portable computer, providing improved performance.

Other objects, advantages and novel features of the invention will become more apparent from the following detailed description of the present embodiment when taken in conjunction with the accompanying drawings.

DETAILED DESCRIPTION OF THE INVENTION

Figure 1:
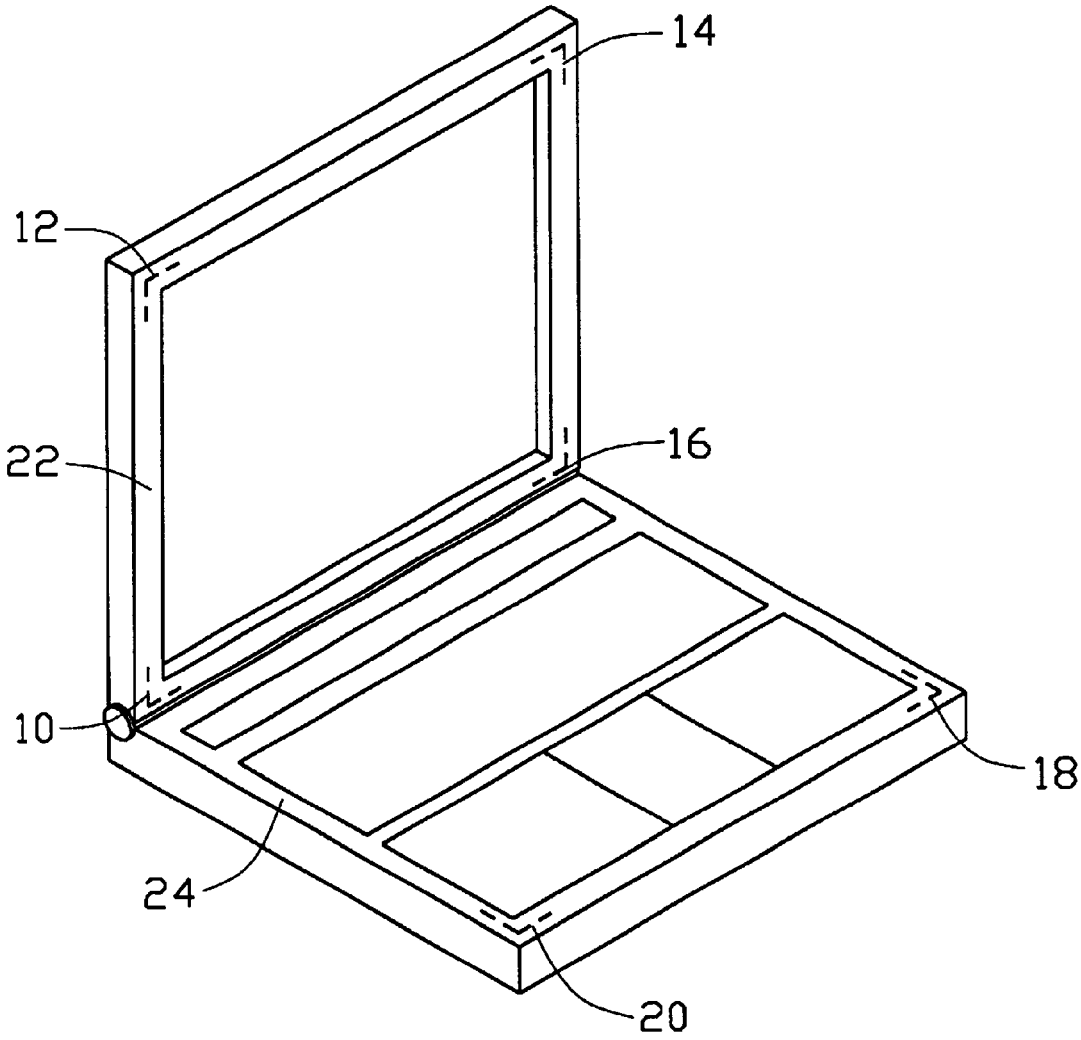
FIG. 1 is a diagrammatic view of a portable computer incorporating an antenna module according to the present invention.
Figure 2:
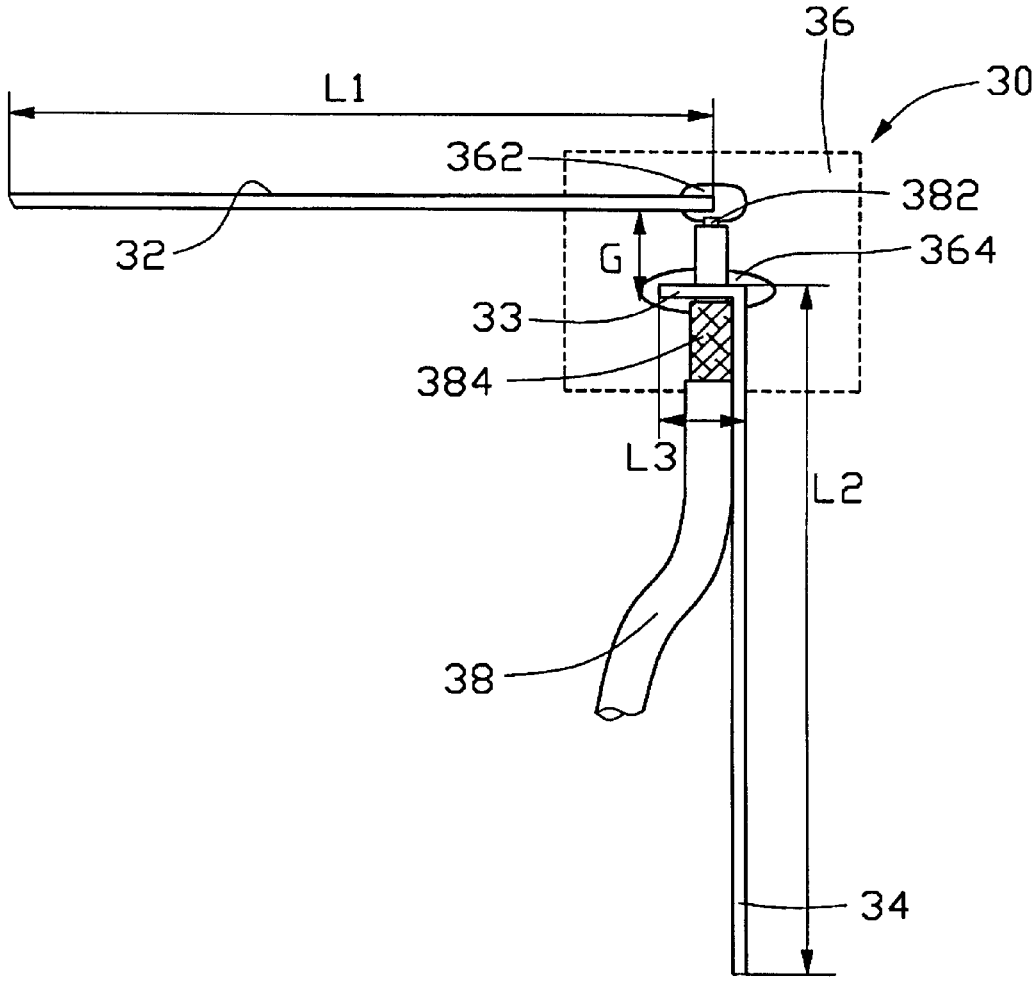
FIG. 2 is a planar view showing a detailed structure of the antenna module according to the present invention.

Referring now to FIGS. 1 & 2, an antenna module 30 in accordance with the present invention is situated inside a portable computer comprising a body portion 24 containing many parts such as a keyboard and a motherboard (not shown), a display portion 22 that may be a liquid crystal display (LCD) or a gas discharge display, and a grounding plane (not shown) corresponding to the antenna module 30. At least one antenna module 30 could be located respectively at one of coners 10,12,14,16,18,20 of the portable computer as shown by dotted lines. The antenna module receives/transmits signals having a frequency within a range of 2.40~2.50GHz. Therefore, said portable computer can exchange data or other signal information with other electronic equipment through wireless telecommunication.

The antenna module 30 comprises a wire first dipole antenna arm 32 having length L1 extending in one direction and a wire second dipole antenna arm 34 having length L2 extending in a second direction perpendicular to the first direction to form an, "L" shaped configuration. The second dipole antenna arm 34 further comprises an additional section 33 having a length L3 and perpendicularly projecting from an end of the second arm 34 near the first arm 32, the additional section having a length shorter than the length of the first arm 32 or second arm 34. The first and second arms 32,34 each are made of a slim wire and are connected to a printed circuit board 36 by respective first and second solder joints 362,364. A gap is formed between said first and second solder joints 362,364 and no additional matching circuitry is provided. Because the second arm 34 is perpendicular to the first arm 32, the antenna module 30 can transmit/receive signals from different directions, thereby obtaining improved performance and making it less susceptible to radio wave blind areas, especially where the invention is to be used in an environment having multiple reflections such as an office-type environment. The total length of the first and second arms 32,34, being L1 plus L2, is equal to half of a wavelength of the transmitting/receiving signal. Therefore, the antenna module 30 is small enough for use in a portable computer, particularly at a right-angle corner of the portable computer. It should be noted that the respective lengths L1,L2 of the first and second arms 32,34 and a distance G, which measures the length of the gap between the first and second solder joints 362,364 influences the voltage standing wave ratio (VSWR) of the antenna module 30. The lower the VSWR is, the stronger the transmitted/received signal. In general, a VSWR larger than one is acceptable. When return loss is larger than 10 dB, the VSWR should be less than two to be in accordance with the requirements of the band covering 2.40~2.50 GHz.

The first and second arms 32,34 are connected to associated transmitting/receiving circuitry by a coaxial cable38. The inner core 382 of the cable 38 is soldered to the first arm 32 at the first solder joint 362 on the printed circuit board 36. An outer sheath 384 is soldered to the second arm 34 at the second solder joint 364 on the printed circuit board 36. Adjusting the distance between two points of attachment of the coaxial cable38 to the printed circuit board 36 as mentioned above, or selecting coaxial cable 38 having different parameters such as impedance, changes the VSWR of the antenna module 30. The function of transfer, matching and balancing between the first and second arms 32,34, which would otherwise be done by matching circuitry, is taken care of by choosing appropriate values of L1 ,L2,G, antenna diameter, and cable parameters. Said antenna arms 32,34 operate at the same frequency simultaneously, and transmit/receive signals through the same circuitry along their respective, mutually perpendicular directions. The antenna module 30 of the present invention provides the same function as an integral antenna, and obtains improved transmitting/receiving performance without increasing the complexity of manufacturing and components.

In one embodiment of the present invention, the length L2 of the second arm 34 of the antenna module 30 is equal to that of the first arm 32, both having a length of 28 mm, and the length L3 of the additional section 33 of the second arm 34 is 3 mm. The gap G has a distance of 2 mm. Furthermore, the diameter of the first and second arms 32,34 is 1 mm, which is thick enough to endure the losses for skin-effect in the range of operating frequencies.

Figure 3:
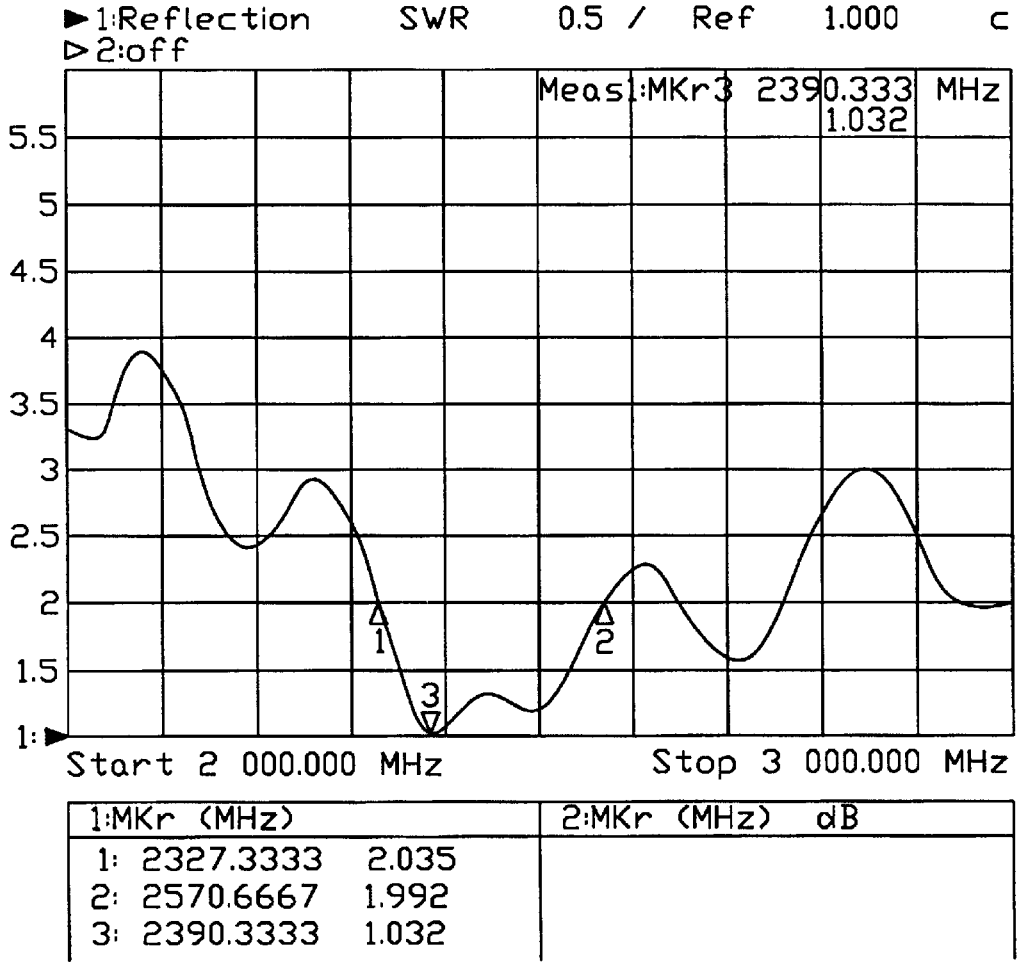
FIG. 3 shows a test result of the antenna module according to the present invention.

The graph shown in FIG. 3 shows a plot of VSWR (on the Y-axis) as a function of frequency (on the X-axis) for the antenna module having the parameters described above. Note that when VSWR is between one and two, the corresponding frequency range is from 2.327 GHz to 2.570 GHz, covering the operating band of 2.40~2.50 GHz.

Of course, the antenna module 30 may also be employed in a larger stationary equipment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module for electronic apparatus comprising:

a first dipole antenna arm extending in a first direction and a second dipole antenna arm extending in a second direction that is different from the first direction, said first dipole antenna arm and said second dipole antenna arm being respectively electrically connected to a printed circuit board at a first point and at a second point, a gap being formed between the first point and the second point, the second dipole antenna arm comprising an additional section perpendicularly projecting from an end thereof near the first dipole antenna arm; and a coaxial cable adapted for interfacing said dipole antenna arms to a transmitting/receiving circuit, having an inner core electrically engaging with the first dipole antenna arm at the first point, and an outer sheath electrically engaging with the second dipole antenna arm at the second point.

2. The antenna module as claimed in claim 1, wherein the first dipole antenna arm and the second dipole antenna arm are equal in length and are arranged to be oriented perpendicularly to one another.

3. The antenna module as claimed in claim 2, wherein the total length of said two arms is equal to one half of a wavelength of an operating frequency signal.

4. The antenna module as claimed in claim 1, wherein the additional section has a length shorter than the length of the first dipole antenna arm or the second dipole antenna arm.

5. The antenna module as claimed in claim 4, wherein the first and second dipole antenna arms each have a length of 28 mm, the additional section has a length of 3 mm, and the gap has a length of 2 mm.

6. The antenna module as claimed in claim 1, wherein the parameters of a length of the first dipole antenna arm, a length of the second dipole antenna arm, a length of the additional section, a length of the gap between the first point and the second point, a diameter of the first dipole antenna arm and a diameter of the second dipole antenna arm, and an impedance of the coaxial cable are chosen to yield a value of calculated VSWR between 1 and 2, and such that the length of the first dipole antenna arm plus the length of the second dipole antenna arm is within 50% of one half a wavelength of operating signals in an upper and lower operating frequency range of the antenna, thereby obviating a need for matching circuitry to perform function of transfer, balancing and matching between the first dipole antenna and the second dipole antenna arm.

7. The antenna module as claimed in claim 1, wherein said antenna module is placed internally at a right corner of an electrical apparatus and operates in a frequency range of 2.40~2.50 GHz.

8. The antenna module as claimed in claim 1, wherein said first and second dipole antenna arms are made of slim wire.

9. The antenna module as claimed in claim 8, wherein the diameter of the wire comprising the first and second dipole antenna arms is equal to 1 mm.

10. A computer comprising:

an antenna module disposed at one corner of the computer;

said antenna module including a wire first dipole antenna arm extending along a first edge section of the computer and a second dipole antenna arm extending along a second edge section which meets the first edge section at said corner, said wire first dipole antenna arm being spaced from the wire second dipole antenna arm without connection therebetween; and a coaxial cable extending along at least one of said wire first and second dipole antenna arms; wherein an inner core of the coaxial cable is electrically connected to one of the wire first and second dipole antenna arms, while an outer sheath is electrically connected to the other of said wire first and second dipole antenna arms.

11. The computer as claimed in claim 10, wherein the wire first and second dipole antenna arms are mechanically connected, respectively, to spaced first and second solder joints on a printed circuit board of the module, and the inner core and the outer sheath are also mechanically connected, respectively, to said spaced first and second solder joints.

12. The computer as claimed in claim 11, wherein the inner core and said one of the first and second dipole antenna arms are electrically connected to each other via one of said first and second solder joints while without any mechanical engagement therebetween.

13. The computer as claimed in claim 11, wherein the outer sheath and said other of the first and second dipole antenna arms are electrically connected to each other via said other of said first and second solder joints while without any mechanical engagement therebetween.

14. A computer comprising:

an antenna module disposed at one corner of the computer;

said antenna module including a wire first dipole antenna arm extending along a first edge section of the computer and a second dipole antenna arm extending along a second edge section which meets the first edge section at said corner, said wire first dipole antenna arm being spaced from the wire second dipole antenna arm without connection therebetween, the second dipole antenna arm comprising an additional section perpendicularly projecting from an end thereof near the first dipole antenna arm, said additional section being spaced from the wire first dipole antenna arm without connection therebetween; and a coaxial cable extending along at least one of said wire first and second dipole antenna arms; wherein an inner core of the coaxial cable is electrically connected to one of the wire first and second dipole antenna arms, while an outer sheath is electrically connected to the other of said wire first and second dipole antenna arms.

15. The computer as claimed in claim 14, wherein the wire first and second dipole antenna arms are mechanically connected, respectively, to spaced first and second solder joints on a printed circuit board of the module, and the inner core and the outer sheath are also mechanically connected, respectively, to said spaced first and second solder joints.

16. The computer as claimed in claim 15, wherein the inner core and said one of the first and second dipole antenna arms are electrically connected to each other via one of said first and second solder joints while without any mechanical engagement therebetween.

17. The computer as claimed in claim 15, wherein the outer sheath and said other of the first and second dipole antenna arms are electrically connected to each other via said other of said first and second solder joints while without any mechanical engagement therebetween.

18. An antenna module for electronic apparatus comprising:

a first dipole antenna arm extending in a first direction and a second dipole antenna arm extending in a second direction that is different from the first direction, said first dipole antenna arm and said second dipole antenna arm being respectively electrically connected to a printed circuit board at a first point and at a second point, a gap being formed between the first point and the second point, the second dipole antenna arm comprising an additional section projecting from an end thereof, the parameters of a length of the first dipole antenna arm, a length of the second dipole antenna arm, a length of the additional section, a length of the gap between the first point and the second point, a diameter of the first dipole antenna arm and a diameter of the second dipole antenna arm, and an impedance of the coaxial cable are chosen to yield a value of calculated VSWR between 1 and 2, and such that the length of the first dipole antenna arm plus the length of the second dipole antenna arm is within 50% of one half a wavelength of operating signals in an upper and lower operating frequency range of the antenna, thereby obviating a need for matching circuitry to perform function of transfer, balancing and matching between the first dipole antenna and the second dipole antenna arm;

a coaxial cable adapted for interfacing said dipole antenna arms to a transmitting/receiving circuit, having an inner core electrically engaging with the first dipole antenna arm at the first point, and an outer sheath electrically engaging with the second dipole antenna arm at the second point.

* * * * *